United States Patent [19]

Henry

[11] 4,111,309

[45] Sep. 5, 1978

[54] ADJUSTABLE GARMENT ASSEMBLY

[76] Inventor: Edgar Henry, 54-15 108th St., Corona, N.Y. 11368

[21] Appl. No.: 791,028

[22] Filed: Apr. 26, 1977

[51] Int. Cl.[2] ..... A47F 7/24

[52] U.S. Cl. ..... 211/104; 211/105.3; 211/180; 211/201

[58] Field of Search ..... 211/87, 105.3, 180, 211/195, 201, 104, 105; 312/4, 5

[56] References Cited

U.S. PATENT DOCUMENTS

| | | | |
|---|---|---|---|
| 351,860 | 11/1886 | Glidden | 312/5 |
| 1,861,871 | 6/1932 | Morden | 211/201 |
| 1,984,827 | 12/1934 | Derman | 211/87 X |
| 2,581,257 | 1/1952 | Ikelheimer | 211/87 |
| 3,215,281 | 11/1965 | Brothers | 211/180 |
| 3,784,020 | 1/1974 | Steiner | 211/105.3 X |
| 3,954,182 | 5/1976 | McEvers | 211/105.3 X |

FOREIGN PATENT DOCUMENTS

| | | | |
|---|---|---|---|
| 461,673 | 11/1913 | France | 211/123 |
| 1,373,537 | 8/1964 | France | 312/5 |
| 68,795 | 4/1915 | Switzerland | 312/4 |

*Primary Examiner*—Roy D. Frazier
*Assistant Examiner*—Robert W. Gibson, Jr.
*Attorney, Agent, or Firm*—Leonard W. Suroff

[57] ABSTRACT

An adjustable garment assembly comprising in combination an inner frame and an outer frame with mounting means for removably securing the inner frame to a door or the like. Coupling means extends between the inner frame and the outer frame, with coupling means comprising expandable sections connected at one end thereof to the inner frame and at the opposite end thereof to the outer frame so as to obtain adjusted positions of the outer frame relative to the inner frame. Supporting means extends between the inner frame and the outer frame and having a plurality of hooks extending downwardly therefrom for receiving hangers thereon for supporting of garments, with the supporting means being longitudinally movable to different positions in conjunction with the coupling means. Closure means extending on each side of the inner frame and the outer frame to enclose same may be utilized and being expandable and contractable with the movement of the outer frame relative to the inner frame.

32 Claims, 6 Drawing Figures

ADJUSTABLE GARMENT ASSEMBLY

BACKGROUND OF THE INVENTION

The present invention relates to an adjustable garment bag assembly adapted to be removably secured to a door or wall-like surface and permit the support of a number of hangers therefrom.

It has often been found that the space provided by closets in an apartment or home is insufficient to meet the needs of the occupants. In many instances people tend to try and hang or support hangers from a single hook behind a door. I have found that it is possible to overcome the shortage of closet space by providing for a collapsible garment bag that is readily secured to one side of a door and is capable of supporting a number of hangers from individual hooks associated therewith.

OBJECTS OF THE INVENTION

An object of the present invention is to provide an adjustable garment assembly that may be readily secured to a door or the like for supporting a plurality of hangers therefrom.

Another object of the present invention is to provide an adjustable garment assembly having a front frame to be mounted on a door or the like with a rear frame in spaced relationship to the front frame with adjustable coupling means extending therebetween to vary the size of the assembly and the number of hangers to be supported thereon.

Another object of the present invention is to provide an adjustable garment assembly that may be in an extended position as well as in a folded position to vary the size thereof.

Another object of the present invention is to provide an adjustable garment assembly which may be readily manufactured and can be totally disassembled for storage thereof.

Other objects and advantages of the present invention will become apparent as the disclosure proceeds.

SUMMARY OF THE INVENTION

The outstanding and unexpected results obtained by the practice of the apparatus of this invention are obtained by a series of features, and elements assembled and working together in interrelated combination.

An adjustable garment assembly comprising in combination an inner frame with an outer frame and mounting means for removably securing the inner frame to a door, wall, or the like. Coupling means extends between the inner frame and the outer frame. The coupling means comprises expandable sections connected at one end thereof to inner frame and at the opposite end thereof to the outer frame so as to obtain adjusted positions of the outer frame relative to the inner frame.

Supporting means extends between the inner frame and the outer frame and has a plurality of hooks extending downwardly therefrom for receiving hangers thereon, and the supporting means is longitudinally movable to different positions in conjunction with the coupling means.

The novel structure of the present invention includes closure means extending on each side of the inner frame and the outer frame to enclose same. The closure means is expandable and contractable with the movement of the outer frame relative to the inner frame.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
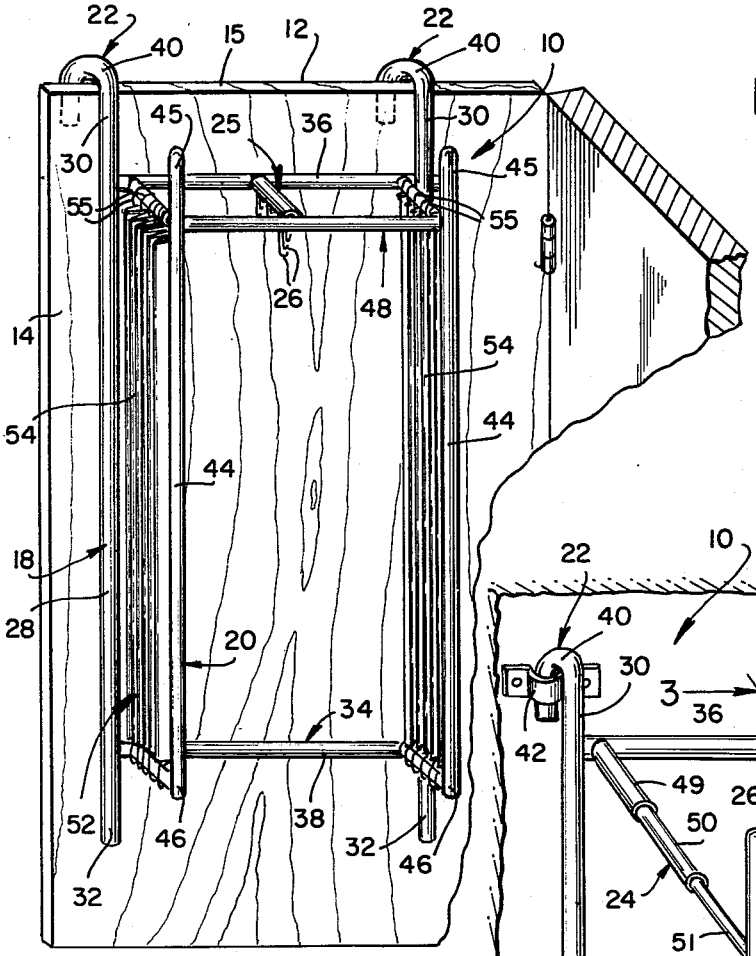
FIG. 1 is a perspective view of an adjustable garment assembly in mounted relationship to a door or the like in a collapsed or folded position in accordance with the present invention.
Figure 2:
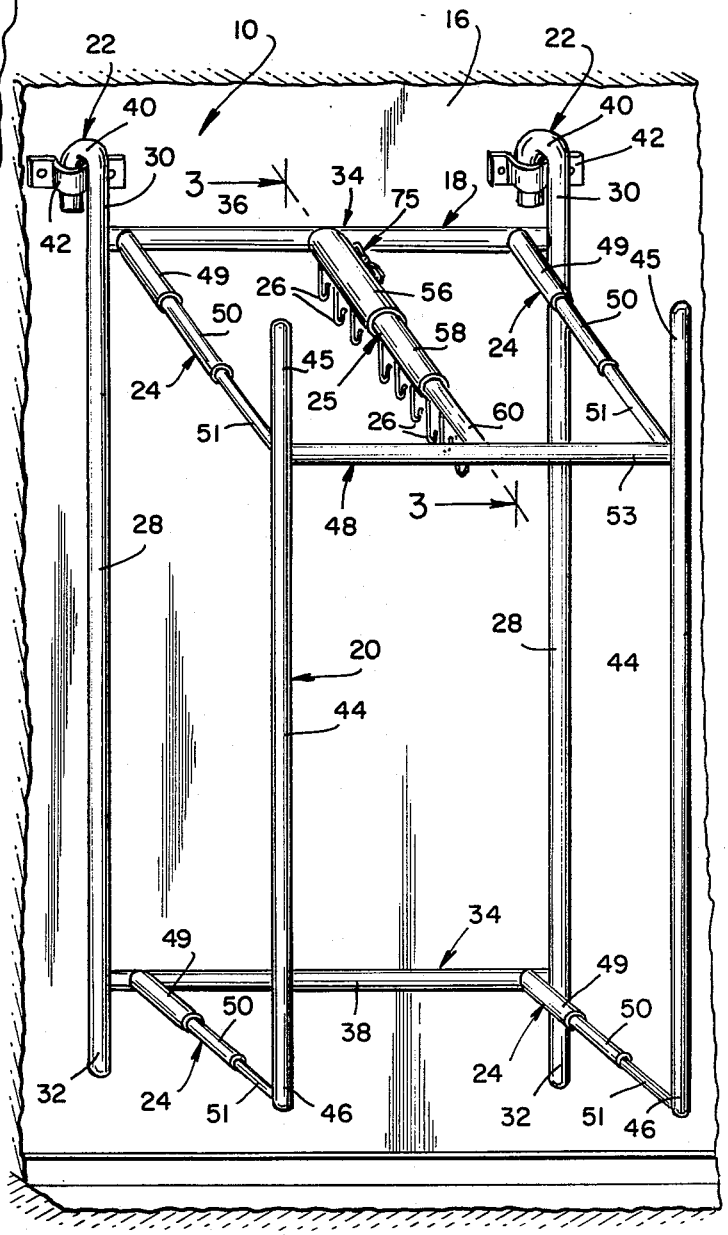
FIG. 2 is a perspective view similar to FIG. 1 illustrating another mounting arrangement, and the adjustable garment assembly in an extended position.

Referring to the drawings, there is illustrated in FIGS. 1–5 one embodiment of an adjustable garment bag assembly 10 in accordance with the present invention. As illustrated in FIG. 1 the assembly 10 may be utilized in conjunction with a door 12 having a front surface 14 and an upper edge 15. In a similar fashion there is illustrated in FIG. 2, the assembly 10 being utilized in conjunction with the wall surface 16. As is well known the need for additional storage space for hanging of garments is often in short supply and, therefore, the present invention may be utilized in conjunction with a door 12 or wall 16. This provides to the user not only an economic savings in that an additional closet does not have to be purchased, but in addition flexibility when visiting or traveling.

The assembly 10 may be easily mounted and removed when use thereof is no longer required. The assembly 10 may be fabricated from metal and includes an inner frame 18, an outer frame 20. Mounting means 22 is provided in conjunction with the inner frame 18 to permit removable securement to a door 12 or wall 16. In addition there is provided coupling means 24 extending between inner frame 18 and outer frame 20. The coupling means 24 being designed to obtain adjusted positions of the outer frame 20 relative to the inner frame 18.

Figure 3:
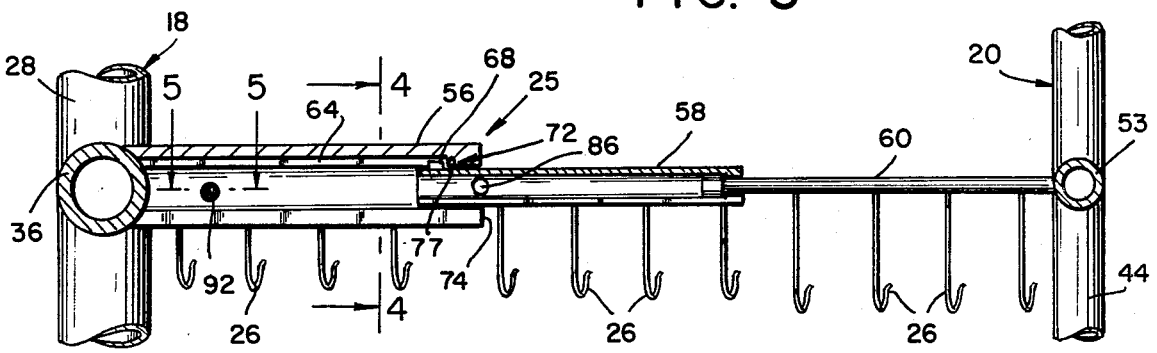
FIG. 3 is a fragmentary sectional view taken along line 3—3 of FIG. 2.
Figure 4:
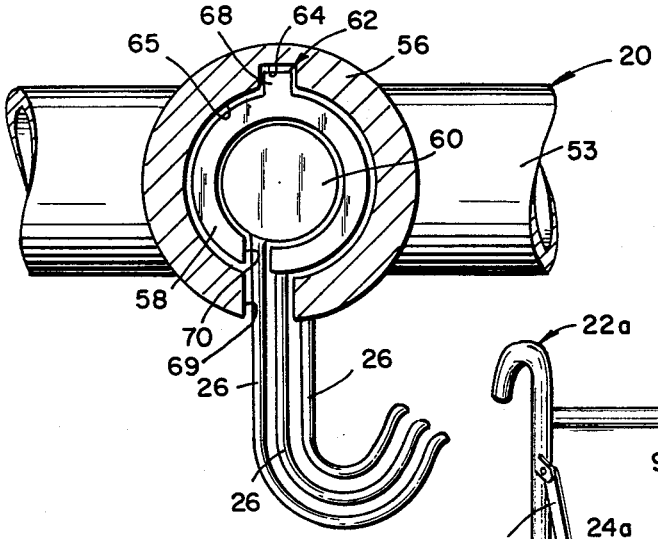
FIG. 4 is an enlarged sectional view taken along line 4—4 of FIG. 3.

The assembly 10 further includes supporting means 25 extending between the inner frame 18 and the outer frame 20 and having a plurality of hooks extending downwardly therefrom for receiving hangers thereon. As illustrated in FIGS. 3 and 4 the length and exact configuration of the hooks 26 may vary so as to permit a nesting relationship therebetween. The supporting means 25 being longitudinally movable to different positions in conjunction with the coupling means 24.

The adjustment of the assembly 10 to different positions is dependent upon the number of hooks that is to be used at a given time. FIG. 1 illustrates the assembly 10 in a retracted or collapsed position, and FIG. 2 illustrates the assembly 10 in an expanded or open position. The inner frame 18 includes a pair of spaced apart vertically extending inner frame members 28 having an upper end 30 and a lower end 32. Inner connecting means 34 extends between the inner frame members 28 for rigidly securing the inner frame members 28 together. The inner connecting means 34 includes an upper extending element 36 and a lower extending element 38 which are then connected at their respective ends to inner frame members 28 such that a rigid structure is formed.

The mounting means 22 may include a hook or curved element 40 extending from each upper end 30 of the inner frame members 28. As illustrated in FIG. 1 hook 40 may extend over the upper edge 15 of door 12.

As illustrated in FIG. 2 the mounting means 22 may further include a pair of brackets 42 adapted to be mounted on the wall 16 or the like. Each one of the brackets 42 is adapted to receive therein one hook 40. In this manner whenever the assembly 10 is to be used the hooks 40 may be reinserted within the brackets 42 so as to obtain the assembly 10 in the position illustrated in FIG. 2. The brackets 42 support the weight of the assembly 10 and the garments to be hung from the hanger hooks 26.

The outer frame 20 includes a pair of spaced apart vertically extending outer frame members 44 having an upper end 45 and a lower end 46. Outer connecting means 48 extend between the outer frame members 44 for rigidly securing them together. Accordingly, the two frames 18 and 20 are rigidly formed, and may be fabricated from light-weight material. As illustrated in FIG. 1, the assembly 10 is such that the coupling means 24 are designed to be telescopically receivable and includes expandable sections 49, 50, and 51. These sections may be tubular in construction with section 49 coupled to the inner frame 18 and section 51 coupled to the outer frame 20.

Although three sections 49, 50, and 51 have been illustrated, it is possible that two sections may be utilized. The longitudinal adjustment of the frames 18 and 20 is permitted by the sections 49, 50, and 51 being interfitting within each other. Although the sections 49 are illustrated as connected to upper elements 36 and lower element 38, they may be directly coupled to the frame members 28 and 44.

The assembly 10 may further include closure means 5 extending on each side of the inner frame 18 and the outer frame 20 to enclose same. The closure means 52 being expandable and contractable with the movement of the outer frame 20 relative to the inner frame 18. The closure means 52, as illustrated in FIG. 1, may be supported by the coupling means 24. The closure means 52 may include an accordian-like member or curtain 54 having clips 55 at each end thereof adapted to extend over sections 49, 50, and 51. In this manner, if desired, the clothes hung on hangers is not readily visible from the sides of the assembly 10.

The supporting means 25 comprises an outer horizontally extending support member 56 and an inner interfitting horizontally extending support member 58 extending in telescopic relationship to each other. In addition there may be provided an extension support member 60 mounted in telescopic relationship the inner support member 58. Each of the members 56, 58, and 60 having a plurality of coat hanger hooks 26 extending downwardly therefrom, as illustrated in FIGS. 3 and 4. Extension member 60 may be coupled at one end thereof to upper extending element 53.

To maintain alignment between outer support member 56 and inner support member 58, there is provided guide means 62. The guide means 62 may include a longitudinally extending groove 64 along the interior 65 of the outer member 56. The inner support member extends inwardly of the interior 65 and has a rib or projection 68 extending outwardly therefrom for sliding engagement within the groove 64.

Although, the outer support member 56, inner support member 58, and extension 60 are illustrated having a circular cross-section, it is appreciated that other shapes and structures can accomplish the same telescopic type relationship. The guide means 62 may be accomplished by providing a longitudinally extending channel 69 in the outer support member 56 that is adapted to receive the hooks depending from the inner support member 58 and extension member 60 as illustrated in FIG. 4. In similar fashion inner support member 58 may be provided with a longitudinally extending channel 70 through which the hooks 26 depending from the extension member 60 are free to move.

This arrangement provides for the desired interrelationship so as to permit the longitudinal sliding adjustment between the members 56, 58, and 60. Stopping means 72 is provided on the forward end 74 of the outer support member 56 and may include a lip 77 at one end of channel 64. In this manner the maximum travel of inner support member 58 outwardly from the outer support member 56 is limited. A similar arrangement may be provided between extension member 60 and inner support member 58.

Figure 5:
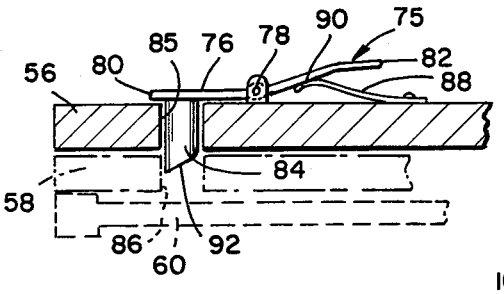
FIG. 5 is a fragmentary sectional view taken along line 5—5 of FIG. 3.

To maintain the assembly 10 in the closed position, as illustrated in FIG. 1, there is provided locking means 75, as illustrated in FIG. 5. The locking means 75 interconnects support members 56 and 58 in the retracted position of the garment assembly 10.

The locking means 75 includes a latch member 76 pivotally mounted at 78 between its respective ends 80 and 82. End 80 having a pin 84 adapted to extend through an opening 85 in the outer support member 56 and within a recess 86 in the inner support member 58. The opposite end 82 being biased into the position to lock the outer and inner support members 56 and 58, respectively, relative to each other. Spring 88 secured to outer support member 56 has a free end 90 which is biased against the end 82 of the latch member 76. The dimensional relationship is such that depressing end 82 will retract the distal end 92 of pin 84 from within recess 86 and free the inner support member 58 to move relative to the outer support member 56.

Accordingly, the embodiment of the invention illustrated in FIGS. 1-5 is designed to be adjusted such that there is different spacings between frames 18 and 20 and the number of hooks 26 may be increased such that the capacity of the assembly 10 may be conveniently varied by the user. The adjustment is easily accomplished with a minimal of effort such that both youngsters and adults may easily make use of the assembly 10.

Figure 6:
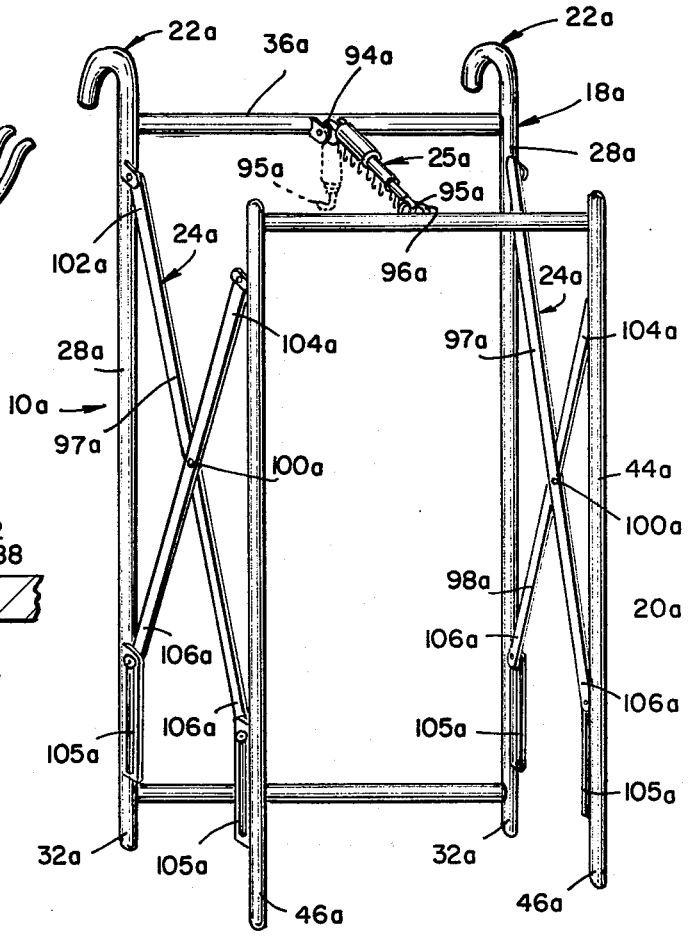
FIG. 6 is a perspective view similar to FIG. 2 of an alternate embodiment of the present invention.

Referring to FIG. 6 there is illustrated another embodiment of the present invention in which the garment assembly **10*a* may include an inner frame 18*a* and outer frame 20*a* with mounting means 22*a* in a manner as described above. The supporting means 25*a* may be similar to that illustrated in FIGS. 3 and 4 except that it is pivotally mounted at one end 94*a* and adapted to be hooked into place at its opposite end 95*a* by means of a catch 96*a*. In this manner in the folded or collapsed position, the supporting means 25*a* may extend from the inner frame 18a by securement to upper element 36a. Catch 96a is secured to element 53a**.

This relationship permits the frames 18a and 20a to almost touch each other in view of the coupling means 24a provided in this embodiment of the invention. The coupling means 24a includes a pair of linked members 97a and 98a that may be pivotally secured at 100a to each other. One end 102a of each link member 97a may be pivotally and fixedly secured to inner frame members 28a. In a similar manner the upper end 104a of each link member 98a may be pivotally and fixedly secured to the outer frame member 44a. To provide the necessary movement of longitudinal adjustment, there is provided a track 105a adjacent to the lower end 32a and 46a of the inner frame members 28a and outer frame members 44a. The track permits sliding movement of the lower end 106a of each of the link members 97a and 98a.

In this manner when the supporting means 25a is lowered, the collapsed position of the coupling means 24a requires a minimal spacing such that in storage of the assembly 10a hardly any space is rquired.

Although illustrative embodiments of the invention have been described in detail herein with reference to the accompanying drawings, it is to be understood that the invention is not limited to the precise embodiments and that various changes and modifications may be effected therein without departing from the scope or spirit of the invention.

I claim:

1. An adjustable garment assembly comprising in combination:

a. an inner frame,
b. mounting means for removably securing said inner frame to a door or the like,
c. an outer frame,
d. coupling means extending between said inner frame and said outer frame,
e. said coupling means comprising expandable sections connected at one end thereof to said inner frame and at the opposite end thereof to said outer frame so as to obtain adjusted positions of said outer frame relative to said inner frame,
f. supporting means extending between said inner frame and said outer frame and having a plurality of hooks extending downwardly therefrom for receiving hangers thereon,
g. said supporting means being longitudinally movable to different positions in conjunction with said coupling means,
h. said inner frame includes a pair of spaced apart vertically extending inner frame members having upper and lower ends,
i. inner connecting means extending between said inner frame members for rigidly securing said inner frame members together,
j. said inner connecting means includes an upper extending element and a lower extending element, said elements connected at their respective ends to said inner frame members such that a rigid structure is formed, and
k. said mounting means includes a hook extending from each said upper end of said inner frame members.

2. An adjustable garment assembly as defined in claim 1, and including closure means extending on each side of said inner frame and said outer frame to enclose same, said closure means being expandable and contractable with the movement of said outer frame relative to said inner frame.

3. An adjustable garment assembly as defined in claim 2, wherein said closure means is supported by said coupling means.

4. An adjustable garment assembly as defined in claim 3, wherein said closure means includes an accordian-like member.

5. An adjustable garment assembly as defined in claim 1, and including a pair of brackets adapted to be mounted on a wall or the like, each one of said brackets adapted to receive therein one said hook.

6. An adjustable garment assembly comprising in combination:

a. an inner frame,
b. mounting means for removably securing said inner frame to a door or the like,
c. an outer frame,
d. coupling means extending between said inner frame and said outer frame,
e. said coupling means comprising expandable sections connected at one end thereof to said inner frame and at the opposite end thereof to said outer frame so as to obtain ajusted positions of said outer frame relative to said inner frame,
f. supporting means extending between said inner frame and said outer frame and having a plurality of hooks extending downwardly therefrom for receiving hangers thereon,
g. said supporting means being longitudinally movable to different positions in conjunction with said coupling means,
h. said outer frame includes a pair of spaced apart vertically extending outer frame members having upper and lower ends, and
i. outer connecting means extending between said outer frame members for rigidly securing said outer frame members together.

7. An adjustable garment assembly as defined in claim 6, wherein said outer connecting means includes an upper extending element connected at the respective ends thereof to said outer frame members such that a rigid structure is formed.

8. An adjustable garment assembly as defined in claim 1, wherein said expandable sections of said coupling means are telescopically receivable within each other so as to permit longitudinal adjustment to different positions of said outer frame relative to said inner frame.

9. An adjustable garment assembly as defined in claim 8, wherein one pair of said expandable sections are connected between said frames at substantially one end thereof and one pair at substantially the opposite end thereof.

10. An adjustable garment assembly as defined in claim 1, wherein said supporting means comprises an outer and an inner horizontally extending support member mounted in interfitting relationship to each other with a plurality of hooks extending downwardly from each of said support members.

11. An adjustable garment assembly as defined in claim 10, and including guide means extending between said outer and inner support members so as to prevent angular displacement therebetween while permitting longitudinal adjustment in conjunction with the movement of said frames selective to each other.

12. An adjustable garment assembly as defined in claim 11, wherein said outer support member is tubular having a longitudinally extending groove therein, and said inner support member extends inwardly thereof and has a rib extending outwardly therefrom for sliding engagement within said groove.

13. An adjustable garment assembly as defined in claim 12, and including an extension support member mounted in telescopic relationship to said inner support member, said extension support member having a plurality of hooks extending downwardly therefrom.

14. An adjustable garment assembly as defined in claim 12, said outer support member having a longitudinally extending channel for receiving said hooks from said inner support member.

15. An adjustable garment assembly as defined in claim 10, and including locking means for releasably interconnecting said support members in at least the retracted position of the adjustable garment assembly.

16. An adjustable garment assembly comprising in combination:

a. an inner frame,
b. mounting means for removably securing said inner frame to a door or the like,
c. an outer frame,
d. coupling means extending between said inner frame and said outer frame,
e. said coupling means comprising expandable sections connected at one end thereof to said inner frame and at the opposite end thereof to said outer frame so as to obtain adjusted positions of said outer frame relative to said inner frame,
f. supporting means extending between said inner frame and said outer frame and having a plurality of hooks extending downwardly therefrom for receiving hangers thereon,
g. said supporting means being longitudinally movable to different positions in conjunction with said coupling means,
h. said supporting means comprises an outer and an inner horizontally extending support member mounted in interfitting relationship to each other with a plurality of hooks extending downwardly from each of said support members,
i. locking means for releasably interconnecting said support members in at least the retracted position of the adjustable garment assembly, and
j. said locking means includes a latch member pivotally mounted between its respective ends, one said end having a pin adapted to extend through an opening in said outer support member and within a recess in said inner support member, and the opposite said end being biased into said position to lock said outer and inner support members relative to each other.

17. An adjustable garment assembly as defined in claim 1, wherein said supporting means is pivotally coupled to one of said frames at one end thereof and removably secured to the other said frame at the other end thereof.

18. An adjustable garment assembly as defined in claim 17, wherein said supporting means is pivotally coupled to said inner frame.

19. An adjustable garment assembly as defined in claim 1, wherein said coupling means includes a pair of link members connected between said inner and outer frames, such that relative movement therebetween is permitted.

20. An adjustable garment assembly as defined in claim 19, wherein each pair of said linked members are pivotally mounted relative to each other between their respective ends, one end of each of said link members being fixedly pivotally secured to said inner and said outer frame, and the opposite end of each of said linked members being pivotally mounted relative to said inner and said outer frame so as to permit longitudinal adjustment therebetween such that the spacing between said frames may be varied.

21. An adjustable garment assembly as defined in claim 20, wherein said longitudinal adjustment is obtained by providing a track on each said frame to receive said one end of said link members for sliding engagement therebetween.

22. An adjustable garment assembly comprising in combination:

a. an inner frame including:
   (1) a pair of spaced apart vertically extending inner frame members having upper and lower ends, and
   (2) inner connecting means extending between said inner frame members for rigidly securing said inner frame members together,
b. mounting means for removably securing said inner frame to a door or the like,
c. an outer frame including:
   (1) a pair of spaced apart vertically extending outer frame members having upper and lower ends, and
   (2) outer connecting means extending between said outer frame members for rigidly securing said outer frame members together,
d. coupling means extending between said inner frame and said outer frame,
e. said coupling means comprising expandable sections connected at one end thereof to said inner frame and at the opposite end thereof to said outer frame so as to obtain adjusted positions of said outer frame relative to said inner frame,
f. said expandable sections of said coupling means are telescopically receivable within each other so as to permit longitudinal adjustment to different positions of said outer frame relative to said inner frame,
g. supporting means extending between said inner frame and said outer frame and having a plurality of hooks extending downwardly therefrom for receiving hangers thereon,
h. said supporting means being longitudinally movable to different positions in conjunction with said coupling means and comprises an outer and an inner horizontally extending support member mounted in interfitting relationship to each other with a plurality of hooks extending downwardly from each of said support members, and
i. guide means extending between said outer and inner support members so as to prevent angular displacement therebetween while permitting longitudinal adjustment in conjunction with the movement of said frames relative to each other.

23. An adjustable garment assembly as defined in claim 22, and including closure means extending on each side of said inner frame and said outer frame to enclose same, said closure means being expandable and contractable with the movement of said outer frame relative to said inner frame.

24. An adjustable garment assembly as defined in claim 22, wherein said inner connecting means includes an upper extending element and a lower extending element, said elements connected at their respective ends to said inner frame members such that a rigid structure is formed.

25. An adjustable garment assembly as defined in claim 22, wherein said outer connecting means includes an upper extending element connected at the respective ends thereof to said outer frame members such that a rigid structure is formed.

26. An adjustable garment assembly as defined in claim 22, wherein one pair of said expandable sections are connected between said frames at substantially one end thereof and one pair at substantially the opposite end thereof.

27. An adjustable garment assembly as defined in claim 22, wherein said outer support member is tubular having a longitudinally extending groove therein, and said inner support member extends inwardly thereof and has a rib extending outwardly therefrom for sliding engagement within said groove.

28. An adjustable garment assembly as defined in claim 27, and including an extension support member mounted in telescopic relationship to said inner support member, said extension support member having a plurality of hooks extending downwardly therefrom.

29. An adjustable garment assembly as defined in claim 27, said outer support member having a longitudinally extending channel for recieving said hooks from said inner support member.

30. An adjustable garment assembly as defined in claim 22, and including locking means for releasably interconnecting said support members in at least the retracted position of the adjustable garment assembly.

31. An adjustable garment assembly as defined in claim 30, wherein said locking means includes a latch member pivotally mounted between its respective ends, one said end having a pin adapted to extend through an opening in said outer support member and within a recess in said inner support member, and the opposite said end being biased into said position to lock said outer and inner support members relative to each other.

32. An adjustable garment assembly as defined in claim 22, wherein said mounting means includes a hook extending from each said upper end of said inner frame members.

* * * * *